United States Patent [19]

Dipoala

[11] Patent Number: 5,077,548

[45] Date of Patent: Dec. 31, 1991

[54] DUAL TECHNOLOGY INTRUDER DETECTION SYSTEM WITH SENSITIVITY ADJUSTMENT AFTER "DEFAULT"

[75] Inventor: William S. Dipoala, Fairport, N.Y.

[73] Assignee: Detection Systems, Inc., Fairport, N.Y.

[21] Appl. No.: 545,540

[22] Filed: Jun. 29, 1990

[51] Int. Cl.[5] ..... G08B 19/00

[52] U.S. Cl. ..... 340/522; 340/506; 340/521; 340/552; 340/554; 340/561; 367/94

[58] Field of Search ..... 340/522, 506, 521, 552, 340/554, 561, 507, 508, 553; 367/93, 94

[56] References Cited

U.S. PATENT DOCUMENTS

| | | | |
|---|---|---|---|
| 4,437,089 | 3/1984 | Achard | 340/522 |
| 4,660,024 | 4/1987 | McMaster | 340/522 |
| 4,710,750 | 12/1987 | Johnson | 340/522 |
| 4,764,755 | 8/1988 | Pedtke et al. | 340/541 |
| 4,833,450 | 5/1989 | Buccola et al. | 340/522 |

*Primary Examiner*—Donnie L. Crosland
*Attorney, Agent, or Firm*—Warren W. Kurz

[57] ABSTRACT

A dual-tech intruder detection system includes a pair of intruder-detecting subsystems, each functioning to detect intrusion by a technology different from the other, and apparatus for activating an alarm in response to both subsystems detecting intrusion within a predetermined time interval. A supervisory circuit serves to detect a malfunction in one of the subsystems. Default apparatus, responsive to the output of the supervisory circuit, causes the alarm activating apparatus to activate an alarm in response to the still-functioning subsystem's detection of intrusion. To reduce false alarms from the still-functioning subsystem, circuit apparatus are provided for reducing the sensitivity of such subsystem in response to the output of the supervisory circuit.

12 Claims, 2 Drawing Sheets

DUAL TECHNOLOGY INTRUDER DETECTION SYSTEM WITH SENSITIVITY ADJUSTMENT AFTER "DEFAULT"

BACKGROUND OF THE INVENTION

The present invention relates to the art of intrusion detection. More particularly, it relates to improvements in intruder detection systems of the so-called "dual technology" variety.

Heretofore, a variety of "technologies" have been used to detect the presence of an intruder in region under surveillance. Microwave, ultrasonic, photoelectric and passive infrared are some of the more common technologies in current use. Each has certain unique advantages and disadvantages which makes it more or less desirable for a particular environment or application. None is fool-proof, and all are subject to the ever-annoying false alarm.

In the never-ending quest to provide a "false alarm-proof" intruder detection system, proposals have been made to combine two (or more) technologies in a common intruder detection system. See, for example, the disclosures of U.S. Pat. Nos. 3,725,888; 3,801,978; 4,243,979; 4,275,390; 4,331,952; 4,401,976; 4,710,750 and 4,833,450. While such proposals go back some thirty years (see, e.g., U.S. Pat. No. 3,074,053), only recently has the cost of electronics reached a level that has made commercialization of a "dual-tech" system viable.

In conventional dual-technology systems, the outputs of the different intruder-detecting subsystems (e.g. microwave and passive infrared subsystems) are fed to an AND gate or its equivalent. Only in the event that the outputs of both subsystems indicate that both subsystems have detected intrusion substantially simultaneously, or within a predetermined, relatively short time interval, will the AND gate provide an alarm-activating signal. The advantage of such a system, of course, is that false alarms will only occur on the relatively rare occasion that spurious, false alarming-producing events are detected by both subsystems at about the same time. By combining relatively diverse technologies, e.g. microwave and photoelectric or passive infrared, the probability of such an occurrence can be minimized.

In the commonly assigned U.S. Pat. No. 4,660,024 issued in the name of R..L. McMaster, there is disclosed a dual technology intruder detection system which incorporates a supervisory circuit for monitoring the operating status of a microwave subsystem. In the event such subsystem stops transmitting microwave energy or otherwise experiences a malfunction which prevents it from detecting intrusion, a supervisory signal is produced. In addition to being used to annunciate the malfunction (e.g., by energizing a light-emitting diode), such supervisory signal serves to cause the system to "default" to a "single" technology detection system (i.e., the still functioning subsystem). In this manner, some measure of protection is provided until the operating status of the malfunctioning subsystem is restored. Note, without such a default feature, the AND gate circuitry prevent the dual technology system from alarming until the malfunction was corrected. This default feature is particularly useful in applications where the user cannot frequently or easily verify the operating status of the system.

In using dual-technology detection systems, it is common for the manufacturer or installer to adjust the sensitivity of each subsystem to a level substantially higher than the sensitivity commonly used in a comparable single-technology or "stand alone" system. The rationale is that, since each subsystem is usually immune to the false alarm-producing sources of the other subsystem, and since both subsystems must alarm simultaneously before a "true" alarm condition (i.e., intruder-produced) can be produced, there can be no disadvantage in setting the sensitivity of each subsystem at its limit. While each subsystem may well produce frequent false alarms, the AND circuitry of such dual-tech systems prevents these false alarms from producing a true alarm condition. While this philosophy may be sound in the case of dual-tech systems having no "default" capability, it can be problematic to dual-tech systems which do incorporate this feature. Specically, it has been observed that within a relatively short time interval after default occurs, the still-functioning subsystem, owing to its unusually high sensitivity setting and/or the normally "harsh" environment in which dual technology are commonly used, false alarms and thereby causes the overall system to alarm.

SUMMARY OF THE INVENTION

In view of the foregoing discussion, an object of this invention is to provide a means for reducing false alarms in a dual-technology intruder detection system which, following a malfunction of one technology, has defaulted to the still-functioning subsystem.

The dual-technology intruder detection system of the invention utilizes the output of a supervisory circuit, indicating that one of the subsystems of the dual-tech system has failed, to produce a reduction in sensitivity of the still-functioning subsystem. Depending on the specific signal processing circuitry of the still-function subsystem, such reduction in sensitivity is achieved, for example, by selectively reducing the gain of certain amplifiers, increasing the threshold levels of certain comparators, and/or adjusting certain timing windows or pulse counts.

The invention and its various advantages will be better understood from the ensuing detailed description of a preferred embodiment, reference being made to the accompanying drawings.

DETAILED DESCRIPTION OF PREFERRED EMBODIMENTS

Figure 1:
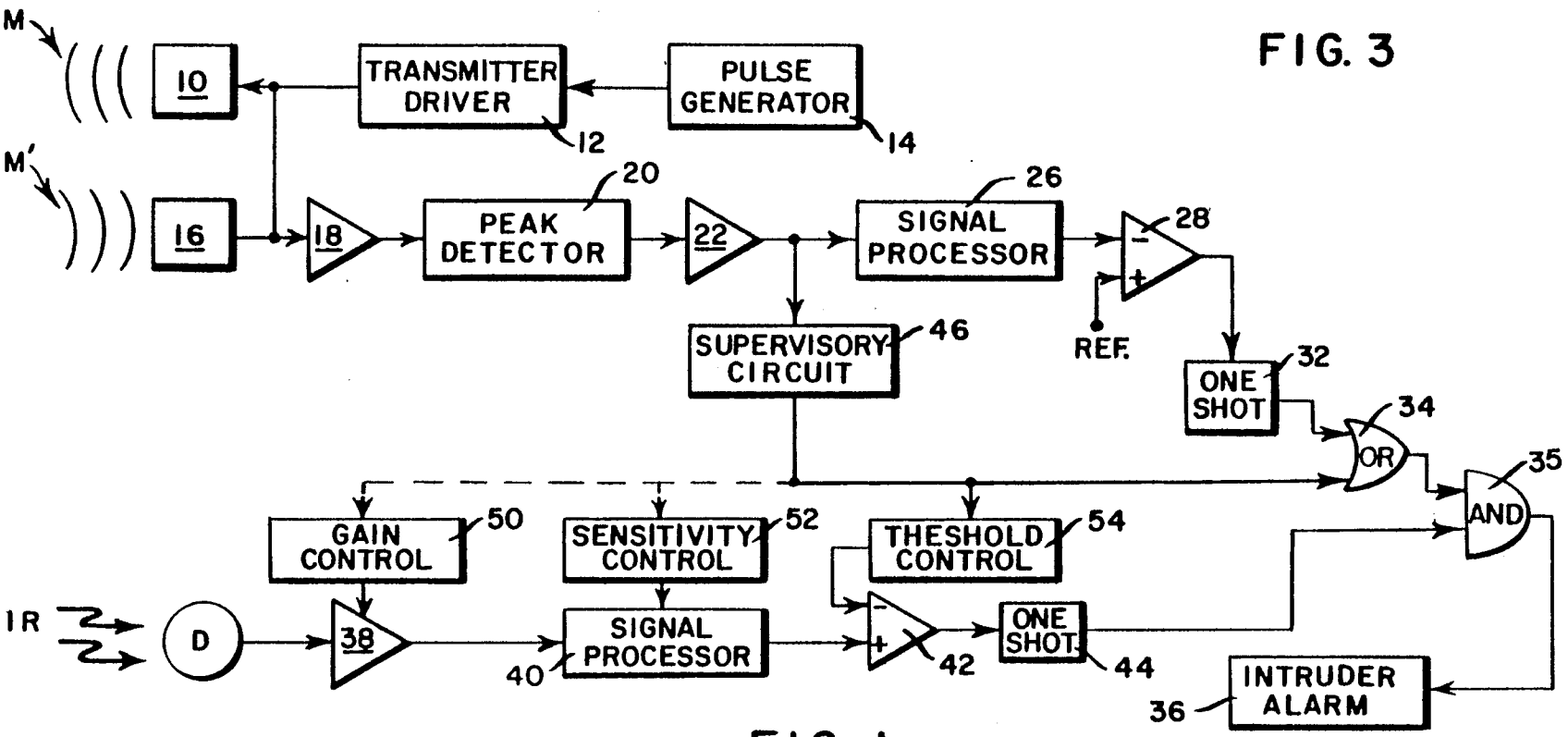
FIGS. 1 and 2 are block circuit diagrams of dual-tech intruder detection systems embodying the present invention.

Referring now to the drawings, FIG. 1 illustrates a dual-tech intruder detection system of the microwave/-passive-infrared (PIR) type. The microwave subsystem is "active" in nature, functioning to transmit microwave energy into a region to be protected from intrusion, and to detect such energy upon being reflected and possibly modified in frequency and/or phase by objects moving within such region. In contrast, the infrared subsystem is "passive" in nature, acting to detect the intruder's presence by his own body heat. As will be apparent, the particular technologies of the intruder detecting subsystems may take any of many forms, active and/or passive, and are not at all critical to the operation of the invention.

Conventional microwave subsystems are commonly of the Doppler variety, typically comprising a Gunn diode 10 which is driven via a driver circuit 12 to produce modulated microwave energy M. The modulation may be produced, for example, by a pulse generator 14 or some other periodic signal source. Movement of objects within the energy field produces a shift in frequency of the transmitted signal, such frequency shift being caused by the well-known Doppler effect. The Doppler frequency is the difference in frequency between the transmitted and motion-shifted frequencies, and it is this Doppler signal which is processed to detect a particular type of movement.

The receiver portion of the microwave subsystem comprises a receiver diode 16 positioned to detect reflected microwave energy M', as returned from the region under surveillance. A portion of the transmitted energy is directly coupled to the receiver, e.g., by locating the receiver diode within the energy field of the transmitting diode. Such coupling is denoted by the coupling line 17. In addition to providing a reference signal for subsequent Doppler frequency detection, the coupled energy also serves to bias the receiver "on" to demonstrate to a supervisory circuit that the transmitter is indeed transmitting and that the receiver is receiving.

In the particular microwave subsystem shown in FIG. 1, the output of receiver diode 16 is fed to an inverting pulse amplifier 18 whose output is peak-detected by detector 20 to produce the Doppler frequency. The Doppler signal is enhanced by amplifier 22 and the output thereof is filtered and further amplified in a conventional manner by an appropriate signal processing circuit 26 to exclude certain false alarm-producing signals. The output of circuit 26 is then threshold-detected by comparator 28 which compares the signal level with a reference voltage (REF). The output of comparator 28 is used to trigger a conventional trigger circuit, e.g., a monostable multivibrator, denoted by one-shot 32. The pulse from the one shot, which may last one second or so, produces a logical "1" at one of the two input terminals of an OR circuit 34, the other terminal being connected to the output of a supervisory circuit 46, described below. When either input to the OR circuit is "1", an output signal is provided to one of the two input terminals of an AND circuit 35, the other terminal being connected to the output of the passive-infrared component, also described below. When both inputs to the AND circuit are "1", an intruder alarm 36 is activated.

Figure 3:
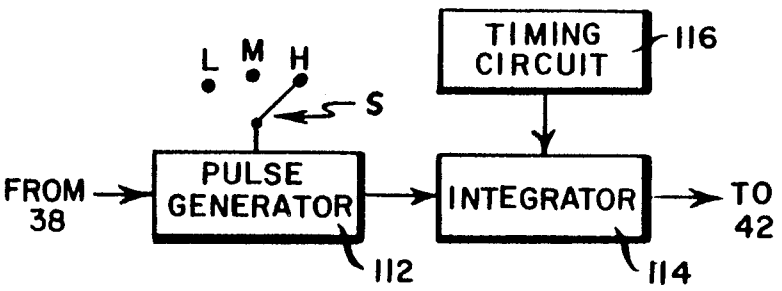
FIG. 3 is schematic of preferred signal processing circuitry for the passive-infrared component of the FIG. 1 system.

Briefly, the infrared subsystem comprises a standard IR detector D which is positioned to be irradiated by the body heat of an intruder within the protected region. Typically, a lens system (not shown) focuses infrared radiation onto the detector, such radiation emanating in one of a plurality of different fields of view within the region under surveillance. The output of detector D is amplified by a variable gain amplifier 38 and, after conventional signal processing by circuit 40 to minimize false alarming, the resulting signal is threshold detected by circuit 42 (e.g., a comparator). A suitable signal processing circuit is shown in FIG. 3. A pulse generator 112 functions to produce pulses each time its input (from amplifier 38) exceeds a predetermined threshold. The threshold may be varied by a switch S to control the pulse amplitude (i.e. low L, medium M, or high H). The output of the pulse generator is integrated by an integrator 114, and a timing circuit 116 operates to discharge the integrator after a predetermined and variable time interval. Such circuitry is better disclosed in the commonly assigned U.S. Pat. No. 4,764,755 issued to D. F. Pedtke and G. E. Behlke, the disclosure of which is incorporated herein by reference. The output of threshold detector 42 is used to trigger a second trigger circuit, here shown as one-shot 44, and the output pulse thereof e.g., a one second pulse, is fed to the other input of AND circuit 34.

To verify that the microwave subsystem is, in fact, functional, a supervision circuit 46 is connected to the output of amplifier 22. The operation of the supervisory aspects of the microwave subsystem is described in the commonly assigned U.S. Pat. No. 4,660,024, issued in the name of R. L. McMaster, the disclosure of which is incorporated by reference. If the output of the supervisory circuit is sustained, indicating a continuous malfunction (e.g. microwave transmission failure), the output of the OR circuit 34 will be sustained, and a logical "1" will appear at the input to AND gate 35. By this arrangement, the system defaults to a "single technology" system (in this case the passive IR technology) in the event of a microwave subsystem failure. In addition to producing a default signal, the output of the supervision circuit can also be used to activate a supervisory alarm 48.

As indicated above, Dual technology systems are commonly used to provide security in unusually "harsh" environments where false alarming of "stand-alone" systems are relatively common. Also, it is common practice in designing and installing dual technology systems with the so-called "default" feature to set the sensitivity of at least one of the subsystems (and usually both) somewhat higher than would be the case were such subsystem a "stand alone" system. Such a higher sensitivity is not a threat to false alarming since, in a dual tech system, both subsystems must alarm substantially simultaneously in order to produce an intruder alarm. In the dual-tech system of FIG. 1, the sensitivity of the passive IR subsystem can be varied, for example, by adjusting the gain control 50 of amplifier 38, the sensitivity control 52 of the signal processing circuit 40, and/or the threshold control 54 of comparator 42.

Now in accordance with the present invention, the output of the supervisory circuit 46 which, when "high", indicates a failure of the microwave component, is used to selectively reduce the sensitivity of the passive infrared component. Preferably, such sensitivity reduction is sufficient to provide a sensitivity which is "normal" for stand-alone units. At the same time, as indicated above, a supervisory alarm 48 (e.g. a light-emitting diode) can be activated by the supervisory circuit to quietly apprise the user of the subsystem failure. Thus, until the subsystem failure is remedied, the passive-IR operates in a "normal" or lower sensitivity mode, rather than its previous "super-sensitive" mode. The sensitivity reduction can be achieved, for example, by coupling the supervisory circuit output to the control circuits, 50, 52 and 54, of the passive IR subsystem, as shown.

Figure 2:
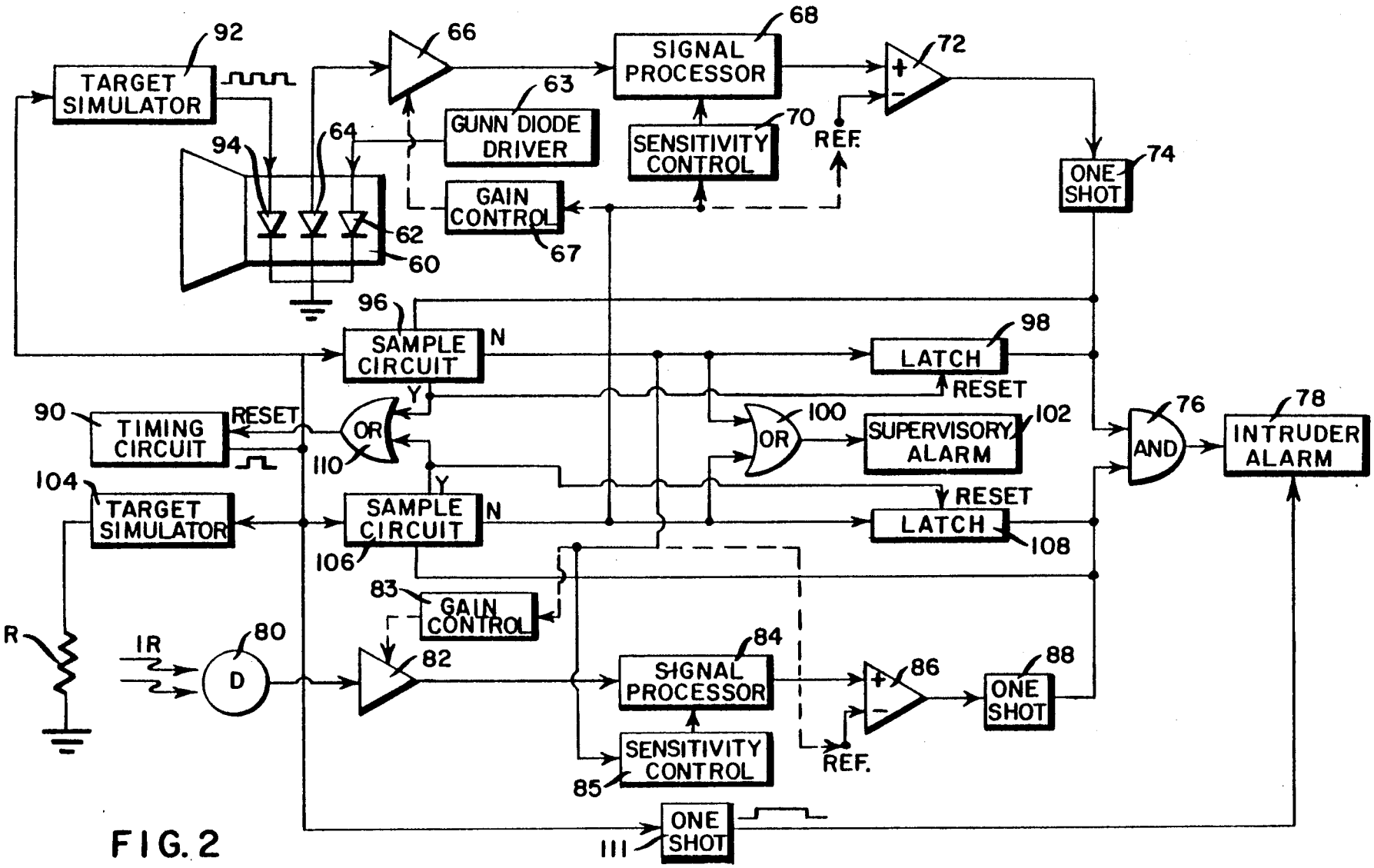

In FIG. 2, a dual-technology system is schematically illustrated in which a failure of either subsystem is used to alter, preferably reduce, the sensitivity of the surviving subsystem. In the FIG. 2 system, the operating status of both subsystems are actively tested periodically by target simulation apparatus, such as disclosed in the commonly assigned U.S. application Ser. No. 492,482, filed in the name of W. Dipoala on Mar. 12, 1990. Like the FIG. 1 system, the dual-tech system of FIG. 2 comprises the combination of microwave and passive-IR subsystems. The microwave subsystem comprises a resonant microwave cavity 60 in which is arranged a standard Gunn diode 62 and a receiver diode 64. The Gunn diode is energized by a driver circuit 63, and the output of the receiver diode is amplified by a variable gain amplifier 66 having its gain set by a gain control circuit 67. The output of amplifier 66 is processed, in a conventional manner, by signal processing circuitry 68 to detect the Doppler frequency and to filter out the effects of certain spurious sources. A sensitivity control 70 operates, in response to its input, to switch the sensitivity of the processing circuitry, for example, by adjusting the integration time of a standard integration circuit. The output of circuit 68 is threshold detected by comparator 72 having an adjustable threshold set by an adjustable reference voltage (REF). The output of comparator 72 is used to trigger a monostable multivibrator or "one-shot" 74 which produces a pulse of predetermined duration. Such pulse serves as the input to AND gate 76. In the event the AND gate receives another input at the same time as it receives an input from one-shot 74, such input coming, of course from the passive-IR component, it activates the intruder alarm 78.

The passive-IR component of the FIG. 2 system comprises an IR detector 80, the output of which being amplified by an amplifier 82. Again, the amplifier gain is variable, being set by gain control circuit 83. The amplifier output is processed by conventional signal processing circuitry 84, such as disclosed in the aforementioned commonly U.S. Pat. No. 4,764,755, and a sensitivity control 85 functions to switch the sensitivity of the signal processing circuit between two different levels. Referring again to FIG. 3, such switching can be accomplished, for example, by controlling the pulse amplitude from pulse generator 112. In FIG. 2, the sensitivity control 85 can vary the sensitivity of the signal processing circuit by, for example, varying the time interval provided by the timing circuit, or varying the amplitude of the current pulses. When the output of the signal processing circuit 84 exceeds the threshold established by threshold detector 86, a one-shot 88 is triggered, and the output pulse thereof is applied to the other input to AND gate 76. As indicated above, when both inputs to the AND gate are "1", the intruder alarm 78 is activated.

To periodically verify the operating status of the microwave and passive-IR components of the FIG. 2 system, a timing circuit 90 functions to periodically produce pulses, say, one pulse of one second duration every hour. Each of such pulses energizes a pair of target simulators 92 and 104 which function to simulate targets, for a one-second time interval for both the microwave and passive-IR components, respectively. Note, during target simulation, the timing circuit output also serves to trigger a one-shot 111 which operates to inhibit the intruder alarm and thereby prevent an "intrusion" alarm during the target simulation procedure.

The output of the microwave target simulator is in the form of a series of low frequency pulses which are applied to a low-cost diode 94 positioned within the microwave cavity. Such pulses, when applied to diode 94, upsets the energy field within the microwave cavity, causing the receiver diode 64 to produce an output like that caused by the movement of a authentic target. Thus, during target simulation, one-shot 74 produces a pulse whenever the microwave subsystem is functioning, and no pulse when such subsystem is non-functioning. The output of one-shot 74 serves as the input to a sample circuit 96 which is enabled by the timing circuit output. If one-shot 74 does not produce a pulse during target simulation, output N of the sample circuit energizes a latch 98 which provides a continuous input to AND gate 76, thereby causing the system to default to the passive-IR mode. Also, the N output of the sample circuit serves to energize a supervisory alarm 102 via OR gate 100. In the event one-shot 74 produces a pulse during target simulation, the Y output of sample circuit produces a pulse which serves to reset the timing circuit via OR gate 110.

The output of the passive-IR target simulator 104 is in the form of a current pulse which is applied to a small heating element, e.g. a resistor R, which is positioned to radiate detector 80. If the IR detector "sees" the simulated target, a pulse is provided by one-shot 88: if not, no pulse is produced. The output of one-shot 88 serves as the input to a sample circuit 106 which is enabled by the timing circuit output. When detector 88 sees the simulated target, the Y output of sample circuit resets the timing circuit via OR gate 110. If it does not see the simulated target, the N output of circuit 106 energizes a latch 108 which provides a continuous input to AND gate 76, thereby causing a default to the microwave mode only. Again, the N output of the sample circuit activates the supervision alarm 102 via OR gate 100. Note, latches 98 and 108 are reset by the Y outputs of sample circuits 96 and 106, respectively.

In the FIG. 2 system, it will be seen that the N outputs from the sample circuits are used to reduce the sensitivity of the still-functioning subsystem. Thus, the N output of sample circuit 96 serves to reduce the gain of amplifier 82 via gain control 83, and/or reduce the sensitivity of the signal processing circuit 84 via sensitivity control 85, and/or increase the threshold of comparator 86 via the reference voltage control (REF). The N output of the sample circuit 106 operates in a similar manner to reduce the sensitivity of the microwave component. The amount of sensitivity reduction is, of course, variable and preferably that required to give the still-functioning subsystem the same sensitivity as a stand alone unit.

The invention has been disclosed with particular reference to certain preferred embodiments. It will be apparent that modifications can be made without departing from the spirit of the invention, and such modifications are intended to fall within the scope of the following claims.

What is claimed is:

1. An intruder detection system comprising:

(a) first and second intruder-detecting subsystems adapted to detect an intruder in a region under survillance by respectively different intruder-detecting technologies, each of said subsystems being operative to produce an output signal in response to the detection of such intruder and at least one of said subsystem including means for varying the sensitivity of its associated subsystem to intrusion detection;

(b) means responsive to the production of output signals from both of said subsystems within a predetermined time interval for producing an intruder alarm signal;

(c) supervisory circuit means operatively connected to the other of said subsystems for producing a supervisory signal in response to a malfunction of said other subsystem, said sensitivity-varying means of said one subsystem being responsive to said supervisory signal to reduce the sensitivity of said one subsystem; and (d) default means, responsive to said supervisory signal, for causing alarm-activating means to produce said intruder alarm signal in response to the receipt of an output signal from only said one subsystem.

2. The apparatus as defined by claim 1 wherein said one subsystem is adapted to detect intrusion by detecting a change in temperature produced by the presence of an intruder in said region under surveillance.

3. The apparatus as defined by claim 3 wherein said one subsystem comprises (i) a temperature-sensitive detector arranged to detect temperature changes in said region, said detector being adapted to produce a variable amplitude signal in response to detecting such temperature changes; (ii) amplifier means, operatively coupled to said variable amplitude signal and having a variable gain for variably amplifying said signal; (iii) signal processing circuitry including means for counting the number of times the output of said amplifier exceeds a predetermined threshold level within a predetermined time interval and for producing an output having an amplitude that varies according to the number counted, said signal processing circuitry including means for varying the amplitude of its output according to the number counted; and (iv) threshold-sensing means for producing a subsystem alarm output in the event the output of said signal processing circuitry exceeds a predetermined threshold level, said threshold-sensing means including means for varying said predetermined threshold level; and wherein said sensitivity-varying means is responsive to said supervisory signal to control the gain of said amplifier means, and/or the output amplitude of said signal processing circuitry, and/or the threshold of said threshold-sensing means.

4. The apparatus as defined by claim 2 wherein said other subsystem is adapted to detect intrusion by detecting a change in a characteristic of energy transmitted by said other subsystem into said region.

5. The apparatus as defined by claim 4 wherein said energy is microwave energy.

6. The apparatus as defined by claim 4 wherein said energy is ultrasonic energy.

7. An intruder detection system comprising:

(a) two intruder-detecting subsystems adapted to detect an intruder in a region under surveillance by different intruder-detecting technologies, each of said subsystems being operative to produce an output signal in response to the detection of such intruder and each subsystem including means for varying the sensitivity of its associated subsystem to intrusion detection;

(b) means responsive to the production of output signals from both of said subsystems within a predetermined time interval for producing an intruder alarm signal;

(c) supervisory circuit means operatively connected to each of said subsystems for producing a supervisory signal in response to a malfunction of its associated subsystem, said sensitivity-varying means of one subsystem being responsive to the supervisory signal of the other subsystem to reduce the sensitivity of said one subsystem; and (d) default means, responsive to the supervisory signal of one subsystem, for causing said alarm-activating means to produce said intruder alarm signal in response to the receipt of an output signal from only said other subsystem.

8. The apparatus as defined by claim 7 wherein one of said subsystems is adapted to detect intrusion by detecting a change in temperature produced by the presence of an intruder in said region under surveillance.

9. The apparatus as defined by claim 8 wherein said one subsystem comprises (i) a temperature-sensitive detector arranged to detect temperature changes in said region, said detector being adapted to produce a variable amplitude signal in response to detecting such temperature changes; (ii) amplifier means, operatively coupled to said variable amplitude signal and having a variable gain for variably amplifying said signal; (iii) signal processing circuitry including means for counting the number of times the output of said amplifier exceeds a predetermined threshold level within a predetermined time interval and for producing an output having an amplitude that varies according to the number counted, said signal processing circuitry including means for varying the amplitude of its output according to the number counted; and (iv) threshold-sensing means for producing a subsystem alarm output in the event the output of said signal processing circuitry exceeds a predetermined threshold level, said threshold-sensing means including means for varying said predetermined threshold level; and wherein said sensitivity-varying means is responsive to said supervisory signal to control the gain of said amplifier means, and/or the amplitude of said signal processing circuitry, and/or the threshold of said threshold-sensing means.

10. The apparatus as defined by claim 9 wherein said other subsystem is adapted to detect intrusion by detecting a change in a characteristic of energy transmitted by said other subsystem into said region.

11. The apparatus as defined by claim 10 wherein said energy is microwave energy.

12. The apparatus as defined by claim 10 wherein said energy is ultrasonic energy.

* * * * *